US005826486A

United States Patent [19]

Shimada

[11] Patent Number: 5,826,486

[45] Date of Patent: Oct. 27, 1998

[54] HYDRAULIC CIRCUIT

[75] Inventor: Yoshiyuki Shimada, Kobe, Japan

[73] Assignee: Shin Caterpillar Mitsubishi Ltd., Japan

[21] Appl. No.: 822,056

[22] Filed: Mar. 24, 1997

[30] Foreign Application Priority Data

Sep. 20, 1996 [JP] Japan ..... 8-249639

[51] Int. Cl.[6] ..... F15B 11/08

[52] U.S. Cl. ..... 91/436; 91/420; 91/437; 60/460

[58] Field of Search ..... 91/436, 437, 442, 91/426, 420; 60/460, 466

[56] References Cited

U.S. PATENT DOCUMENTS

| | | | |
|---|---|---|---|
| 4,216,706 | 8/1980 | Brundidge | 91/436 |
| 4,509,405 | 4/1985 | Bates | 91/420 |
| 4,531,449 | 7/1985 | Reith | 91/420 |
| 4,624,445 | 11/1986 | Putnam | 91/420 X |
| 4,727,792 | 3/1988 | Haussler | 91/420 |
| 4,732,076 | 3/1988 | Ewald | 91/420 |

FOREIGN PATENT DOCUMENTS

| | | | |
|---|---|---|---|
| 2314590 | 9/1974 | Germany | 91/420 |

*Primary Examiner*—Hoang Nguyen
*Attorney, Agent, or Firm*—Morrison Law Firm

[57] ABSTRACT

Cylinder drift resulting from internal leakage of a recycling circuit, which recycles oil returned from the arm cylinder of a hydraulic shovel to the hydraulic supplying end, is reduced by an hydraulic circuit which includes a recycle valve attached directly to a control valve. When working fluid is returned from a rod chamber of arm cylinder into the control valve, the recycle valve recycles a part of the working fluid through a recycle selector valve to the hydraulic supplying end. A pilot operated check valve is disposed in the oil channel that connects the rod chamber and recycle selector valve together. When extending arm cylinder of the hydraulic shovel, pilot pressure from control valve shifts a pilot selector valve in such a direction as to open pilot operated check valve. When control valve is at the neutral position, pilot selector valve is shifted back to the return position and closes pilot operated check valve so that return oil of arm cylinder is prevented from working on recycle selector valve. Thus, internal leakage of recycle selector valve is prevented.

4 Claims, 2 Drawing Sheets

HYDRAULIC CIRCUIT

BACKGROUND OF THE INVENTION

The present invention relates to a hydraulic circuit for a construction machine or the like.

Shown in FIG. 2 is an example of a conventional hydraulic circuit wherein a valve incorporating an arm-in recycling circuit (hereinafter called a recycle valve 12) is of a type directly attached to an arm-switching section of a control valve of a conventional hydraulic shovel.

In the configuration shown of an arm cylinder switching main spool 1*a* of a pilot operated control valve 1, when pilot pressure is supplied to a pilot line 2 for extending the arm cylinder, main spool 1*a* is shifted to the right. As a result, pressure oil supplied from a pressure oil source 3 flows through a main oil channel 4 into a chamber at the head side (hereinafter called a head chamber 6) of an arm cylinder 5, and oil in a rod-side chamber (hereinafter called a rod chamber 7) of arm cylinder 5 flows through a main oil channel 8. Then the oil flows through main spool 1*a* into a tank oil channel 9 so that a rod 10 moves to the right, i.e. in such a direction as to extend the arm.

At that time, when pilot pressure is supplied through a pilot line 11 that is branched from arm cylinder extending pilot line 2 into the pilot chamber of a recycle selector valve 13 provided in arm recycle valve 12, recycle selector valve 13 is shifted upward so that a part of return oil from rod chamber 7 flows through an oil channel 14 and a check valve 15 and then through recycle selector valve 13 into head chamber 6 during the time that pressure in head chamber 6 is lower than pressure in rod chamber 7. Therefore in the configuration shown, a greater quantity of fluid is supplied into head chamber 6 so that the arm cylinder extends faster, as compared with other configurations which do not include a recycle selector valve as described above.

Under normal circumstances, a return oil control aperture 16 of main spool 1*a* is narrowed to a sufficiently small opening in order to improve the recycling effect by increasing recycled oil flowing from the rod side to the head side. Should pressure at the head-side become higher than pressure at the rod-side, however, the flow of recycled oil becomes blocked at check valve 15, and the recycling operation is therefore stopped.

With recycling thus hindered, the flow rate of oil passing through return oil control aperture (a throttle) 16 of main spool 1*a* increases, which in turn generates boost pressure at main oil channel 8. In order to prevent this, the circuit is provided with what is generally called an unloading valve 17 to release oil in main oil channel 8 into the tank when the pressure at the head-side exceeds a specified value.

By means of the pressure at the head-side which has been directed through a pilot line 18 branched from main oil channel 4, unloading valve 17 is actuated to perform the unloading function, thereby connecting main oil channel 8 to a tank oil channel 19.

According to the configuration of the conventional hydraulic circuit described above, holding pressure is generated in main oil channel 8 when a work load W in the direction represented by an arrow in the drawing (i.e. in the extending direction) is applied to rod 10 in the state where main spool 1*a* is at the neutral position—in other words when the cylinder is held immobile.

At such times, a part of the oil trapped in rod chamber 7 and main oil channel 8 leaks from main spool 1*a* and recycle selector valve 13, causing the arm cylinder to drift. This drifting action is usually called "natural descent of the cylinder arm".

Especially in the configuration described above, because a larger quantity of oil leaks from recycle selector valve 13 compared with the configurations where recycle valve 12 is not provided, the distance descended by the cylinder is increased by the amount of increased of oil leakage.

OBJECTS AND SUMMARY OF THE INVENTION

It is an object of the present invention to overcome the limitations of the prior art.

In order to solve the above problem, an object of the present invention is to provide a hydraulic circuit which is capable of reducing the drift distance of a hydraulic actuator caused by an internal leakage of a recycling circuit that recycles oil to the hydraulic pressure supplying section when the oil returns from the hydraulic actuator.

According to an embodiment of the present invention, a hydraulic circuit is provided to recycle a part of the working fluid through a recycle selector valve to the hydraulic supplying end when the working fluid is returned from a hydraulic actuator into a control valve, the hydraulic circuit having a drift reduction valve which operates together with shifting of the control valve to the neutral position so that the drift reduction valve closes the oil channel that links the return oil end of the hydraulic actuator with the recycle selector valve.

With the above embodiment configuration, even if a workload is applied to the hydraulic actuator when the control valve is at the neutral position to hold the hydraulic actuator immobile, the combined actions of the drift reduction valve which has been closed, together with the shifting of the control valve to the neutral position, prevents the oil returned from the hydraulic actuator from reaching the recycle selector valve. Thus, the present invention restricts drift of the hydraulic actuator caused by leakage from the recycle selector valve.

According to another embodiment of present invention, a hydraulic circuit is provided which includes a pilot selector valve for pilot manual operation of the drift reduction valve, wherein the drift reduction valve is a pilot operated check valve to be opened by the pilot selector valve. The pilot selector valve is controlled together with the recycle selector valve by means of pilot pressure that operates the control valve.

With the embodiment configuration as above, should internal leakage occur at the pilot selector valve that operates the pilot operated check valve, it is possible to limit the internal leakage from the pilot selector valve to a sufficiently small quantity because, unlike the recycle selector valve, the pilot selector valve, being a valve for controlling pilot fluid, can be made sufficiently small for fine control.

According to another embodiment of the present invention, a hydraulic circuit is provided, wherein the drift reduction valve is disposed in the oil channel that links the recycle selector valve with a rod chamber of an arm cylinder which operates the arm of a hydraulic shovel.

With this embodiment configuration as above, should the rod of the arm cylinder receive a workload in such a direction as to extend the arm in the cylinder holding mode, the drift reduction valve prevents the oil in the rod chamber of the arm cylinder from reaching the recycle selector valve, thereby preventing increase in the natural distance descended by the cylinder which is otherwise caused by internal leakage from the recycle selector valve.

The above, and other objects, feature and advantages of the present invention will become apparent from the following description read in conjunction with the accompanying drawings in which like reference numerals designate the same element.

Briefly stated, cylinder drift resulting from internal leakage of a recycling circuit, which recycles oil returned from the arm cylinder of a hydraulic shovel to the hydraulic supplying end, is reduced by an hydraulic circuit which includes a recycle valve attached directly to a control valve. When working fluid is returned from a rod chamber of arm cylinder into the control valve, the recycle valve recycles a part of the working fluid through a recycle selector valve to the hydraulic supplying end. A pilot operated check valve is disposed in the oil channel that connects the rod chamber and recycle selector valve together. When extending arm cylinder of the hydraulic shovel, pilot pressure from control valve shifts a pilot selector valve in such a direction as to open pilot operated check valve. When control valve is at the neutral position, pilot selector valve is shifted back to the return position and closes pilot operated check valve so that return oil of arm cylinder is prevented from working on recycle selector valve. Thus, internal leakage of recycle selector valve is prevented.

According to an embodiment of the present invention, an hydraulic circuit recycles a portion of a working fluid through a recycle selector valve to a hydraulic supplying end when the working fluid is returned from a hydraulic actuator into a control valve, the hydraulic circuit includes a drift reduction valve which operates together with a shifting of the control valve to a neutral position, the drift reduction valve effective to close an oil channel that links a return oil end of the hydraulic actuator with the recycle selector valve.

According to another embodiment of the present invention, an hydraulic circuit further includes a pilot selector valve for pilot-operating the drift reduction valve, wherein the drift reduction valve is a pilot operated check valve opened by the pilot selector valve, the pilot selector valve controlled together with the recycle selector valve by means of a pilot pressure that operates the control valve.

According to another embodiment of the present invention, an hydraulic circuit further includes the drift reduction valve is disposed in an oil channel that links the recycle selector valve with a rod chamber of an arm cylinder which operates the arm of a hydraulic shovel.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
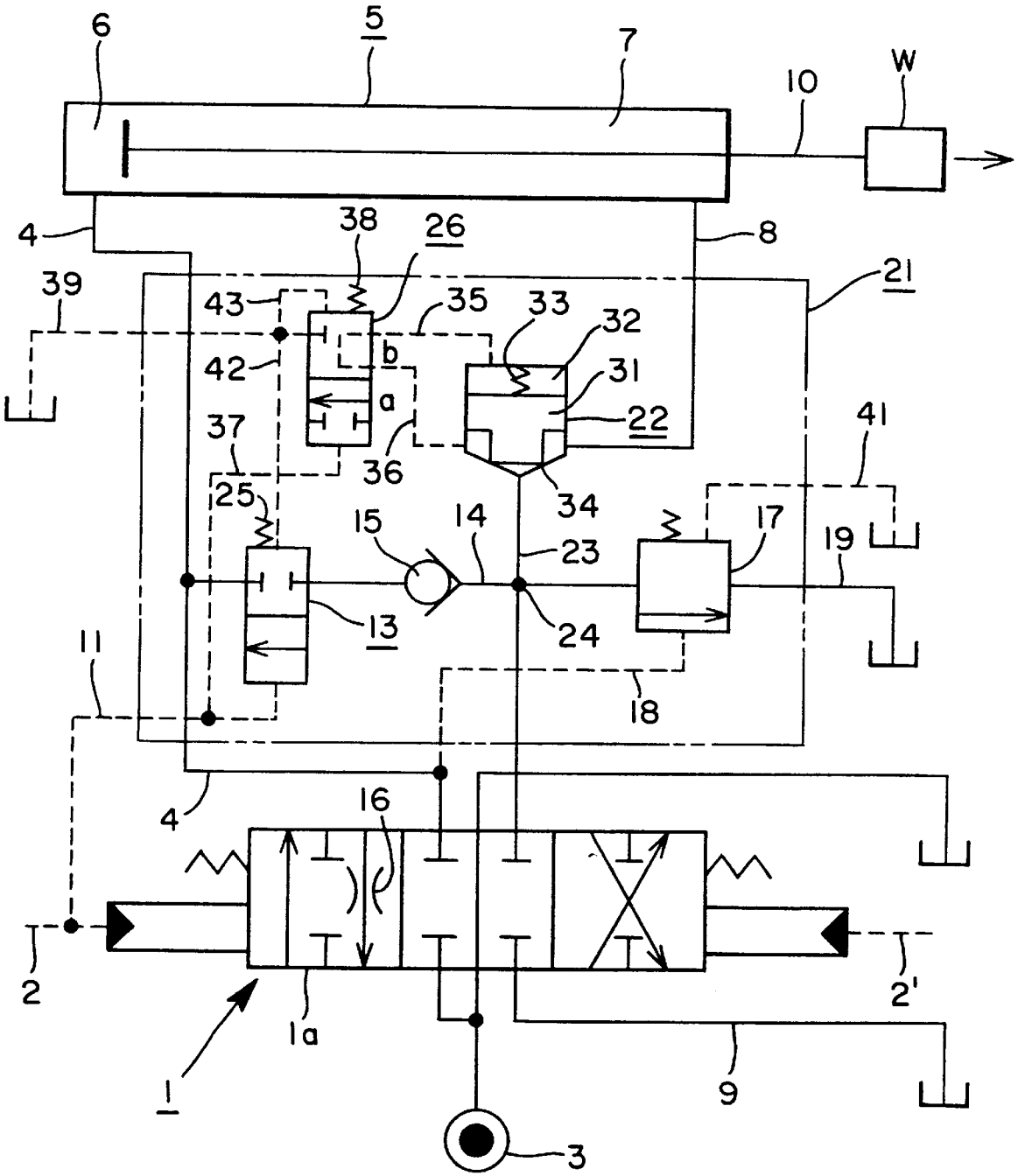
FIG. 1 is a circuit diagram of a hydraulic circuit according to an embodiment of the present invention.
Figure 2:
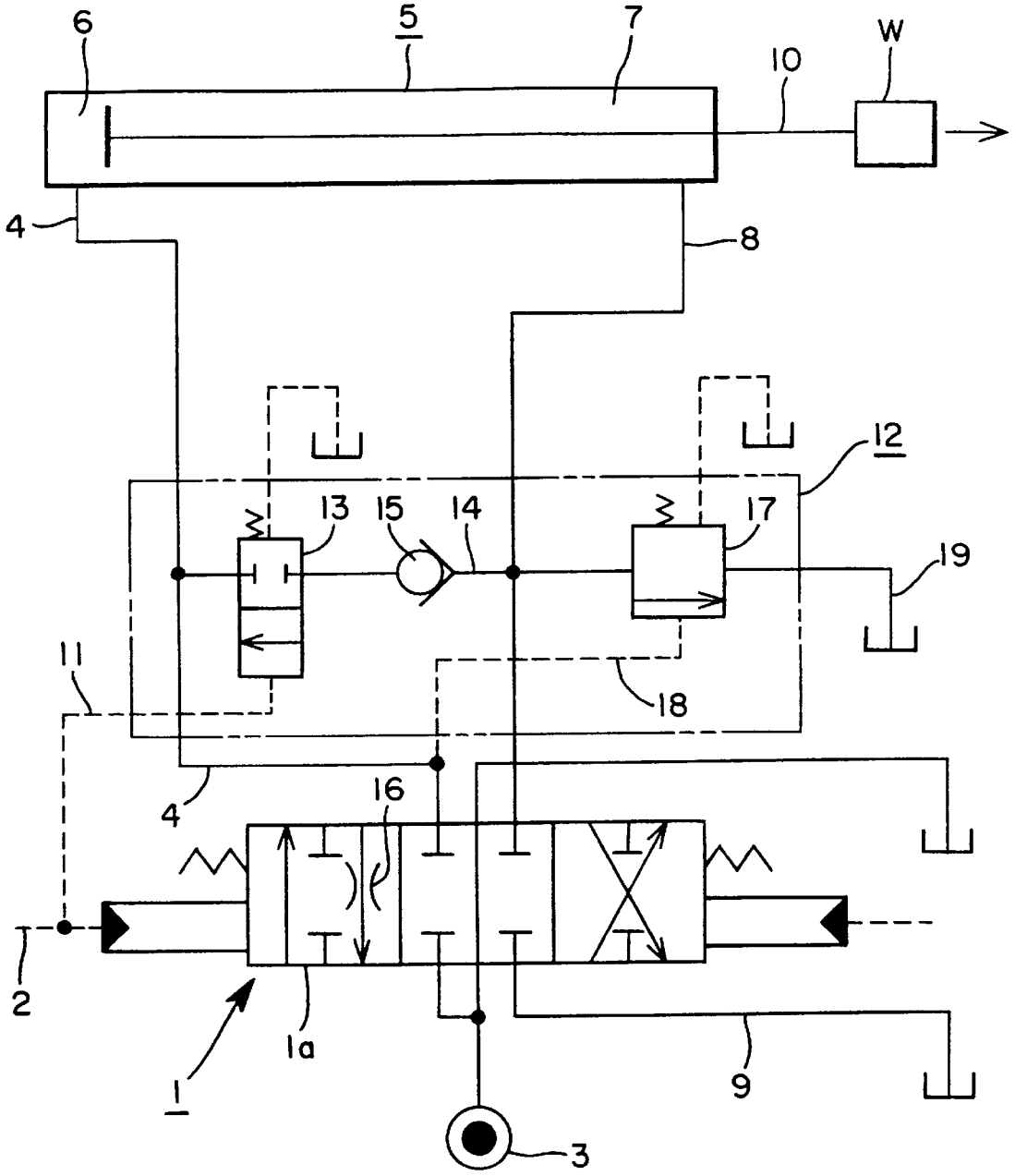
(PRIOR ART) FIG. 2
FIG. 2 is a circuit diagram of a conventional hydraulic circuit.

Next, the configuration of an embodiment of the invention is explained hereunder, referring to a hydraulic circuit for controlling the arm cylinder of a hydraulic shovel as shown in FIG. 1. The structures of the parts similar to those in the example of conventional circuits shown in FIG. 2 are also explained.

Referring to FIG. 1, a pilot line 2 for extending the arm cylinder communicates with one end of an arm cylinder switching main spool 1*a* (hereinafter simply called a main spool 1*a*) of a pilot operated control valve 1, while a pilot line 2' for contracting the arm cylinder communicates with the other end of main spool 1*a*.

Pressure oil source 3 is connected to the supply port of control valve 1, while a chamber at the head side (hereinafter called head chamber 6) of an arm cylinder 5 which serves as a hydraulic actuator for such uses as, for example, driving the arm of an hydraulic shovel is connected through main oil channel 4 to one of the output ports of control valve 1.

By means of main oil channel 8, a chamber at the rod side (hereinafter called rod chamber 7) of arm cylinder 5 communicates with a pilot operated check valve 22 incorporated in an arm-in valve which has a recycling circuit according to the invention and is of a type directly attached to the control valve. The described arm-in valve is hereinafter called an arm recycle valve 21. The aforementioned pilot operated check valve 22, which serves as a drift reduction valve for reducing cylinder drift, is explained later.

Main oil channel 8 is connected through the inside of pilot operated check valve 22 to a main oil channel 23, which communicates through a branching portion 24 with the other output port of control valve 1. The oil discharge port of control valve 1 communicates through a tank oil channel 9 with a tank.

A pilot line 11 branched from arm cylinder extending pilot line 2 communicates with the pilot chamber of a recycle selector valve 13 in arm recycle valve 21. A return spring 25 is disposed at the opposite end of recycle selector valve 13.

One of the two ports of recycle selector valve 13 is linked through a check valve 15 with an oil channel 14 branched from main oil channel 23, while the other port of recycle selector valve 13 is linked with oil channel 4 at the head-chamber side. The spool of recycle selector valve 13 selectively opens or blocks communication between the two ports.

In order to prevent generation of boost pressure in main oil channel 23, which is caused by increase in flow rate of oil passing through return oil control aperture (throttle) 16 of main spool 1*a*, a tank oil channel 19 extending from branching portion 24 incorporates an unloading valve 17 which releases oil in main oil channel 23 into the tank when the pressure at the head-side in main oil channel 4 exceeds a specified value.

Operated by pressure exceeding a specified value, which is introduced through a pilot line branched from main oil channel 4, said unloading valve 17 opens a tank oil channel 19, thereby linking main oil channel 23 with the tank.

Provided in arm recycle valve 21 are a pilot operated check valve 22 for reducing cylinder drift and a pilot selector valve 26 for operating pilot operated check valve 22 using pilot pressure. Pilot operated check valve 22 is disposed between rod chamber 7 of arm cylinder 5 and recycle selector valve 13.

In the configuration of pilot operated check valve 22, a poppet 31 which blocks the communicative passage between main oil channels 8 and 23 is slidably disposed in the valve body, and a compression spring 33 is provided in a spring chamber 32 located at one end of poppet 31 so that compression spring 33 constantly pushes poppet 31 against a seat portion 34 at the other end. Further, an oil channel 35 drawn from spring chamber 32 and an oil channel 36 which communicates with main oil channel 8 are connected to pilot selector valve 26.

Pilot selector valve 26 mentioned above has a pilot chamber at one side of its spool and a return spring 38 at the other side of the spool, the pilot chamber receives pilot pressure supplied through a pilot line 37. Pilot line 37 is branched from a pilot line 11 which is itself branched from pilot line 2 for extending the arm cylinder.

The spool of pilot selector valve 26 has two positions:

operating position (a) for linking oil channel 35, which is drawn from spring chamber 32 of pilot operated check valve 22, with a drain line 39, and return position (b) for directing the holding pressure in main oil channel 8, through an internal path of selector valve 26 and oil channel 35, into spring chamber 32 of pilot operated check valve 22.

Next, the function of the embodiment shown in FIG. 1 is explained below, wherein the explanation of the parts which overlap those parts of the example of conventional circuits shown in FIG. 2 is omitted.

When main spool 1*a* has been shifted to the arm cylinder extending position by means of pilot pressure conveyed through arm cylinder extending pilot line 2, working fluid is supplied from pressure oil source 3 through main spool 1*a* and main oil channel 4 into head chamber 6 of arm cylinder 5, and return oil, flowing from rod chamber 7 of arm cylinder 5 through main oil channel 8, works upon pilot operated check valve 22.

At that time, by means of pilot pressure supplied from arm cylinder extending pilot line 2 through pilot lines 11 and 37, pilot selector valve 26 is shifted to position (a). As a result, spring chamber 32 of pilot operated check valve 22 becomes connected through the internal path of pilot selector valve 26 to drain line 39. As pressure in spring chamber 32 reaches the draining pressure, poppet 31 is pushed upward by the return pressure conveyed from rod chamber 7 of arm cylinder so that main oil channels 8 and 23 are communicated with each other, permitting the return oil to flow from rod chamber 7.

In other words, when the pressure in head chamber 6 is lower than the pressure in rod chamber 7, oil returned from rod chamber 7 flows through main oil channel 8, main oil channel 23, oil channel 14 and check valve 15, and the recycled oil is then supplied into main oil channel 4 through recycle selector valve 13, which has been switched to the through state by means of pilot pressure conveyed from arm cylinder extending pilot line 2 through pilot line 11.

When main spool 1*a* of control valve 1 is shifted to the neutral position in order to hold rod 10 in arm cylinder 5 immobile, the holding pressure in main oil channel 8 at the side where rod chamber 7 is located is conveyed through oil channel 36, the internal path of pilot selector valve 26 and oil channel 35 into spring chamber 32. This is because no pilot pressure is in arm cylinder extending pilot line 2, and pilot selector valve 26 is therefore held at return position (b) by return spring 38. As a result, poppet 31 is pushed against seat portion 34 so that the communicative passage between main oil channel 8 and main oil channel 23 is completely blocked by poppet 31.

Therefore, should work load W in the direction represented by an arrow in the drawing (i.e. in the extending direction) be applied to rod 10 of arm cylinder 5 in the cylinder immobilized mode, oil in main oil channel 8 is prevented from reaching either control valve 1 or recycle selector valve 13. Thus, the "natural descent of the cylinder" which might otherwise be caused by internal leakage of these valves is restricted.

Providing pilot operated check valve 22 between rod chamber 7 of arm cylinder 5 and recycle selector valve 13 in order to reduce cylinder drift especially prevents increase in the natural distance descended by the cylinder which is otherwise caused by internal leakage from recycle selector valve 13 when the cylinder is in the immobilized state. Oil channel 42 and drain line 39 constitute the route of internal leakage of recycle selector valve 13.

Internal leakage may also occur at pilot selector valve 26 that operates pilot operated check valve 22. In this case, too, oil leaks through oil channel 43 and drain line 39. However, as pilot selector valve 26 is provided for the purpose of controlling pilot fluid, its size can be reduced to a sufficient extent compared with recycle selector valve 13, which receives fluid from main oil channel 23. In other words, internal leakage from pilot selector valve 26 can be limited to a level so low that no actual damage results.

As described above, the embodiment of the invention shown in FIG. 1, which relates to an arm recycle valve 21 incorporating a recycling circuit, such as an arm-in circuit of a hydraulic shovel or the like, said recycle valve being of a type directly attached to a control valve, includes a cylinder drift reduction circuit which principally comprises a pilot operated check valve 22 and a pilot selector valve 26. Because of inclusion of said cylinder drift reduction circuit, the embodiment is capable of preventing an increase of cylinder drift which results from using a recycling circuit incorporating valve of a direct attachment type.

Although it is preferable that the present invention is applied to a recycle circuit incorporating valve of a type directly attached to a control valve, such as an arm-in circuit of a hydraulic shovel or the like, the applicable range of the invention is not limited to an arm-in circuit of a hydraulic shovel; it may also be applied to hydraulic circuits of other construction machines than a hydraulic shovel (e. g. a loader) or machines of other types (e. g. a crane), as long as the hydraulic circuit has a recycling circuit to recycle a part of return oil through a recycle selector valve to the hydraulic pressure supplying section when the oil returns from a hydraulic actuator to the control valve. Further, a recycle circuit incorporating valve (a recycle valve) does not always have to be directly attached to a control valve. Furthermore, although it is preferable that pilot operated check valve 22 and pilot selector valve 26 are incorporated in recycle valve 21, they may be disposed outside recycle valve 21.

According to an embodiment of the present invention, should workload be applied to a hydraulic actuator when the hydraulic actuator is at the immobilized state due to a control valve being at the neutral position, a drift reduction valve which has been closed together with the shifting of the control valve to the neutral position prevents oil from leaking from a recycle selector valve when the oil returns from the hydraulic actuator. Therefore, the present invention is capable of effectively restricting drift of the hydraulic actuator which is caused by leakage from the direction control valve.

According to another embodiment of the present invention, unlike the recycle selector valve, a pilot selector valve for pilot-operating an pilot operated check valve that serves as the drift reduction valve can be made sufficiently small, because the purpose of the pilot selector valve is to control pilot fluid. Therefore, the present invention is capable of effectively restricting drift of the hydraulic actuator by limiting leakage from the pilot selector valve to a sufficiently low level.

According to another embodiment of the present invention, should the rod of the arm cylinder of a hydraulic shovel receive workload in such a direction as to extend the arm when the cylinder is held immobile, the drift reduction valve protects the recycle selector valve from the holding pressure and thereby prevents internal leakage of the recycle selector valve. The present invention is thus capable of preventing increases in the natural distance descended by the cylinder which is otherwise caused by internal leakage from the recycle selector valve. Further, the present invention is effective in supporting the arm of a hydraulic shovel against such a load as the weight of the arm itself and the load of objects in the bucket at a position where the arm is held during its descent.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

Although only a single or few exemplary embodiments of this invention have been described in detail above, those skilled in the art will readily appreciate that many modifications are possible in the exemplary embodiment (s) without materially departing from the novel teachings and advantages of this invention. Accordingly, all such modifications are intended to be included within the scope of this invention as defined in the following claims, In the claims, means-plus-function clauses are intended to cover the structures described herein as performing the recited function and not only structural equivalents but also equivalent structures, This although a nail and screw may not be structural equivalents in that a nail relies entirely on friction between a wooden part and a cylindrical surface whereas a screw's helical surface positively engages the wooden part in the environment of fastening wooden parts, a nail and a screw may be equivalent structures.

What is claimed is:

1. An hydraulic circuit for recycling a portion of a working fluid from a rod chamber of a hydraulic actuator, through a recycle selector valve, to a head chamber of said hydraulic actuator, said hydraulic circuit including:

fluid supply means for supplying a flow of said working fluid to said hydraulic actuator;

a control valve for controlling flow of said working fluid between said fluid supply means and said hydraulic actuator, said control valve being operable between first and second positions, wherein said hydraulic actuator is, respectively, extended and retracted, and a neutral position, wherein said hydraulic actuator is held substantially immobile; and a drift reduction valve operable, when said control valve is in said neutral position, to bar flow of said working fluid between said rod chamber of said hydraulic actuator and said recycle selector valve.

2. The hydraulic circuit of claim 1, wherein said drift reduction valve comprises a pilot operated check valve and a pilot selector valve operable to open said pilot operated check valve; said pilot selector valve, said recycle selector valve and said control valve being actuated by a common pilot pressure.

3. An hydraulic circuit comprising:

an hydraulic actuator;

a working fluid source;

a supply conduit, connecting said working fluid source and said hydraulic actuator, for supplying working fluid to said hydraulic actuator;

a return conduit, connecting said working fluid source and said hydraulic actuator, for returning working fluid from said hydraulic actuator;

a control valve for controlling flow of working fluid between said hydraulic actuator and said working fluid source, said control valve being operable between first and second positions, wherein said hydraulic actuator is, respectively, extended and retracted, and a neutral position, wherein said hydraulic actuator is held substantially immobile;

a recycle conduit connecting said supply conduit and said return conduit;

a recycle selector valve operable to control flow of working fluid through said recycle conduit; and a drift reduction valve operable, when said control valve is in said neutral position, to prevent flow through said supply conduit to said recycle selector.

4. The hydraulic circuit of claim 3, wherein said drift reduction valve comprises:

a pilot operated check valve; and a pilot selector valve operable to open said pilot operated check valve;

said pilot selector valve, said recycle selector valve and said control valve being actuated by a common pilot pressure.

* * * * *